US007724116B2

(12) United States Patent
Lee

(10) Patent No.: US 7,724,116 B2
(45) Date of Patent: May 25, 2010

(54) SYMMETRICAL INDUCTOR

(75) Inventor: Sheng-Yuan Lee, Taipei (TW)

(73) Assignee: VIA Technologies, Inc., Taipei (TW)

( * ) Notice: Subject to any disclaimer, the term of this patent is extended or adjusted under 35 U.S.C. 154(b) by 737 days.

(21) Appl. No.: 11/610,652

(22) Filed: Dec. 14, 2006

(65) Prior Publication Data

US 2008/0012678 A1 Jan. 17, 2008

(30) Foreign Application Priority Data

Jul. 12, 2006 (TW) ..... 95125447 A

(51) Int. Cl.
*H01F 5/00* (2006.01)

(52) U.S. Cl. ..... 336/200

(58) Field of Classification Search ..... 336/200
See application file for complete search history.

(56) References Cited

U.S. PATENT DOCUMENTS 7,057,488 B2 * 6/2006 Van Haaren et al. ..... 336/200

2009/0195343 A1 * 8/2009 Tiemeijer ..... 336/200

* cited by examiner

*Primary Examiner*—Lincoln Donovan
*Assistant Examiner*—Joselito Baisa
(74) *Attorney, Agent, or Firm*—Thomas, Kayden, Horstemeyer & Risley

(57) ABSTRACT

A symmetrical inductor. The inductor comprises first, second, third and fourth semi-circular conductive lines disposed in an insulating layer on a substrate, having first and second ends, respectively. The second semi-circular conductive line makes the first semi-circular conductive line symmetric, in which the first ends of the first and second semi-circular conductive lines are electrically connected to each other. The third semi-circular conductive line is parallel to and located outside the first semi-circular conductive line, in which the second ends of the third and second semi-circular conductive lines are electrically connected to each other. The fourth semi-circular conductive line makes the third semi-circular conductive line symmetric, in which the second ends of the fourth and first semi-circular conductive lines are electrically connected to each other. The first, second, third and fourth semi-circular conductive lines have the same line width and the same line space, in which the line space exceeds the line width when the line width is less than 6 μm.

19 Claims, 4 Drawing Sheets

SYMMETRICAL INDUCTOR

BACKGROUND OF THE INVENTION

1. Field of the Invention

The invention relates to a semiconductor device, and in particular to a symmetrical inductor in differential operation.

2. Description of the Related Art

Many digital and analog elements and circuits have been successfully applied to semiconductor integrated circuits. Such elements may include passive components, such as resistors, capacitors, or inductors. Typically, a semiconductor integrated circuit includes a silicon substrate. One or more dielectric layers are disposed on the substrate, and one or more metal layers are disposed in the dielectric layers. The metal layers may be employed to form on-chip elements, such as on-chip inductors, by current semiconductor technologies.

Conventionally, the on-chip inductor is formed over a semiconductor substrate and employed in integrated circuits designed for radio frequency (RF) band. FIG. 1 is a plane view of a conventional on-chip inductor with a planar spiral configuration. The on-chip inductor is formed in an insulating layer 104 on a substrate 100, comprising a spiral metal layer 103 and an interconnect structure. The spiral metal layer 103 is embedded in the insulating layer 104. The interconnect structure includes conductive plugs 105 and 109, a metal layer 107 embedded in an underlying insulating layer (not shown), and a metal layer 111 embedded in the insulating layer 104. A current path is created by the spiral metal layer 103, the conductive plugs 105 and 109, and the metal layers 107 and 111 to electrically connect internal or external circuits to the chip.

A principle advantage of the planar spiral inductor is increased circuit integration due to fewer circuit elements located off the chip along with attendant need for complex interconnections. Moreover, the planar spiral inductor can reduce parasitic capacitance induced by the bond pads or bond wires between on-chip and off-chip circuits.

The planar spiral inductor, however, occupies a larger area of the chip and has lower quality factor (i.e. Q value). To reduce chip area and improve Q value, thickness of the spiral metal layer 103 is increased, and line space S1 between the inner and outer coils is reduced. Additionally, a two-level spiral inductor has been disclosed. Generally, in the same inductance, the two-level spiral inductor needs only ½ to ¼ of the chip area of the one-level spiral inductor. Moreover, the two-level spiral inductor requires fewer coils for the same inductance. Thus, quality factor is improved due to fewer coils providing less resistance.

Although the two-level spiral inductor has less resistance and better quality factor, wireless communication chip designs are more frequently using differential circuits to reduce common mode noise, with inductors applied therein symmetrically. The symmetrical application results in the inductor having the same structure from any end. The planar spiral inductor shown in FIG. 1 and the two-level spiral inductor are not symmetrical, and, if applied in a differential circuit, will not suitably prevent common mode noise.

BRIEF SUMMARY OF INVENTION

A detailed description is given in the following embodiments with reference to the accompanying drawings.

A symmetrical inductor is provided. An embodiment of an inductor comprises an insulating layer, a first conductive line, a second conductive line, a third conductive line, and a fourth conductive line. The conductive lines are all disposed in the insulating layer and have a first end and a second end. Additionally, the second end of the third conductive line is electrically connected to the second end of the second conductive line. The second end of the fourth conductive line is electrically connected to the second end of the first conductive line. The first conductive line and the second conductive line are symmetric, and the third conductive line and the fourth conductive line are symmetric. Moreover, the line width of the first, second, third, and fourth conductive lines and the line space of two adjacent conductive lines have a first relationship: if the line width exceeds 6 μm, the line space is less than the line width; or if the line width is less than 6 μm, the line space exceeds the line width; or if the line width is equal 6 μm, the line space is equal to the line width.

A symmetrical inductor is provided. An embodiment of an inductor comprises an insulating layer, a first conductive line, a second conductive line, a third conductive line, and a fourth conductive line. The conductive lines are all disposed in the insulating layer and have a first end and a second end. Additionally, the second end of the third conductive line is electrically connected to the second end of the second conductive line. The second end of the fourth conductive line is electrically connected to the second end of the first conductive line. The first conductive line and the second conductive line are symmetric, and the third conductive line and the fourth conductive line are symmetric. Moreover, the line width of the fifth and sixth conductive lines and the line space of two adjacent conductive lines have a second relationship: if the line width does not exceed 9 μm, $S=[-W/6+2]\times W$, where S is the line space and W is the line width; or if the line width is not less than 9 μm, $S=0.5W$, where S is the line space and W is the line width.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is provided for the purpose of illustrating the general principles of the invention and should not be taken in a limiting sense. The scope of the invention is best determined by reference to the appended claims. The symmetrical inductor of the invention will be described in the following with reference to the accompanying drawings.

Figure 1:
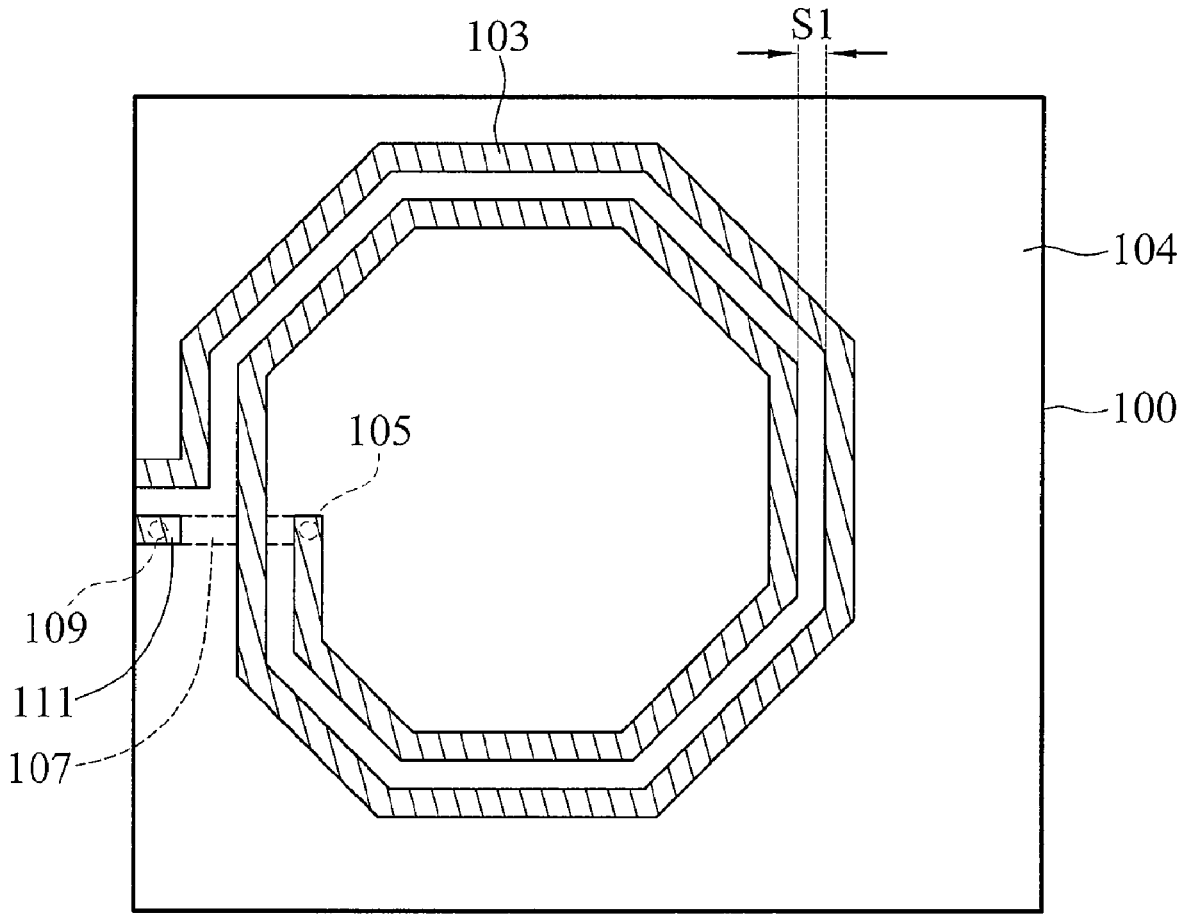
FIG. 1 is a plane view of a conventional on-chip inductor with a planar spiral configuration.
Figure 2:
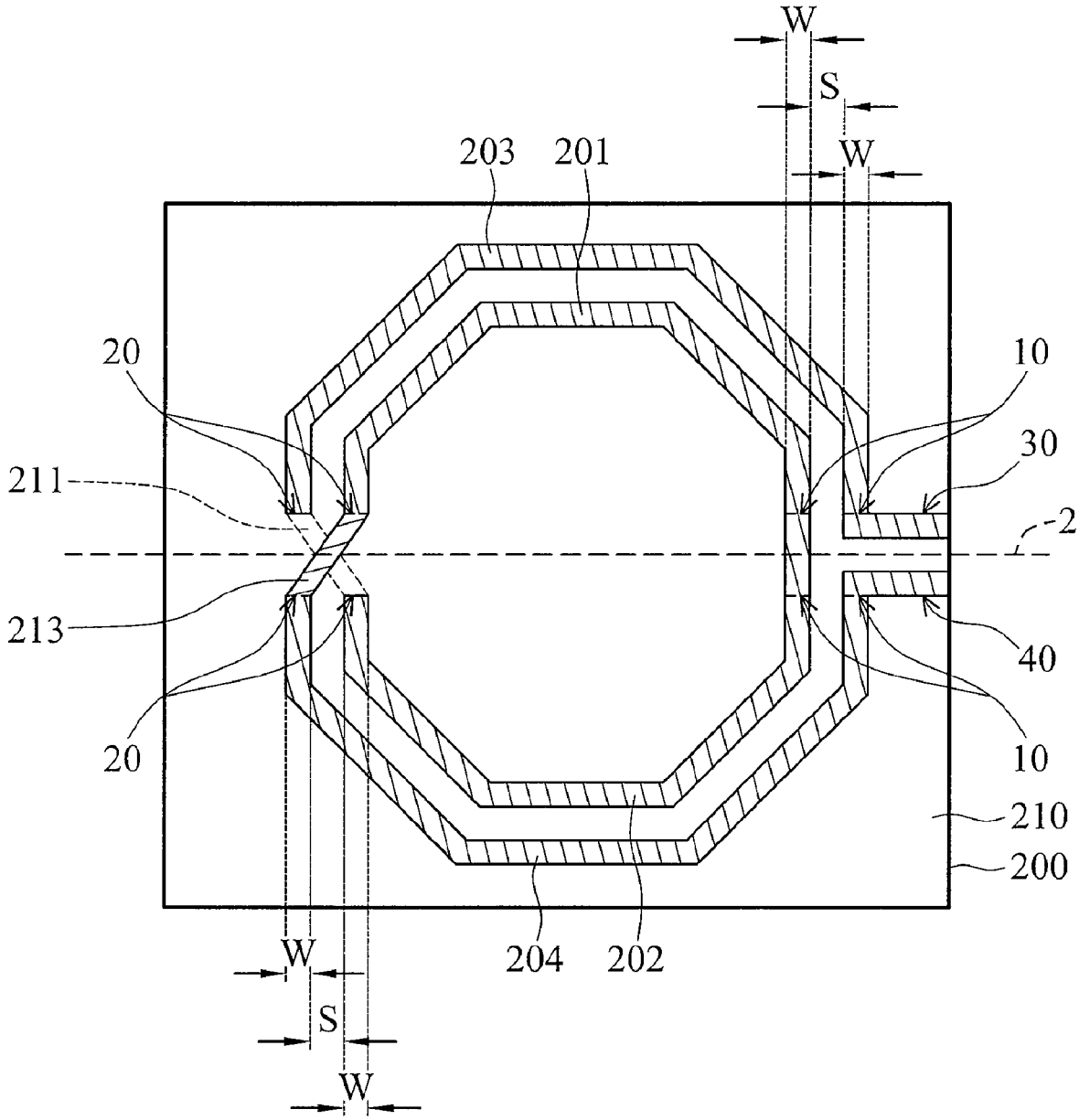
FIG. 2 is a plane view of an embodiment of a two-turn symmetrical inductor.

FIG. 2 is a plane view of a symmetrical inductor of an embodiment of present invention. The symmetrical inductor may be arranged in an insulating layer 210 of a semiconductor chip (not shown) and comprise a first semi-circular conductive line 201, a second semi-circular conductive line 202, a third semi-circular conductive line 203, and a fourth semi-circular conductive line 204. The insulating layer 210 is disposed on a substrate 200. The substrate 200 may include a silicon substrate or other known semiconductor substrates. The substrate 200 may include various elements, such as transistors, resistors, or other well-known semiconductor elements. Moreover, the substrate 200 may also include other conductive layers (e.g. copper, aluminum, or alloy thereof) and insulating layers (e.g. silicon oxide, silicon nitride, or low-k dielectric material). Hereinafter, to simplify the diagram, only a flat substrate is depicted. Additionally, the insulating layer 210 may be a single low-k dielectric layer or multi-layer dielectrics. In this embodiment, the insulating layer 210 may include silicon oxide, silicon nitride, or low-k dielectric material.

The first semi-circular conductive line 201 is disposed in the insulating layer 210 and located at a first side of dashed line 2. The second semi-circular conductive line 202 is disposed in the insulating layer 210 and located at a second side opposing the first side of the dashed line 2, in which the second semi-circular conductive line 202 and the first semi-circular conductive line 201 are symmetrical with respect to the dashed line 2. The first and second semi-circular conductive lines 201 and 202 may be in a shape that is circular, rectangular, hexagonal, octagonal, or polygonal. To simplify the diagram, only an exemplary octagonal shape is depicted. Moreover, the first and second semi-circular conductive lines 201 and 202 may comprise copper, aluminum, or alloy thereof. In this embodiment, the first and second semi-circular conductive lines 201 and 202 have the same line width W. Moreover, each of the first and second semi-circular conductive lines 201 and 202 has first and second ends 10 and 20. The first end 10 of the second semi-circular conductive line 202 extends to and electrically connects with the first end 10 of the first semi-circular conductive line 201.

The third semi-circular conductive line 203 is disposed in the insulating layer 210 and is located at the first side of the dashed line 2. Moreover, the third semi-circular conductive line 203 is parallel to and located outside the first semi-circular conductive line 201. The fourth semi-circular conductive line 204 is disposed in the insulating layer 210 and is located at the second side of the dashed line 2. The third semi-circular conductive line 203 and fourth semi-circular conductive line 204 are symmetrical with respect to the dashed line 2, such that the fourth semi-circular conductive line 204 is parallel to and located outside the second semi-circular conductive line 202. Third and fourth semi-circular conductive lines 203 and 204 together form an octagon. The third and fourth semi-circular conductive lines 203 and 204 may comprise the same material as the first and second semi-circular conductive lines 201 and 202 do.

In this embodiment, the third and fourth semi-circular conductive lines 203 and 204 have the same line width W, and the line space S between the third and first semi-circular conductive lines is same as that between fourth and second semi-circular conductive lines 204 and 202. In some embodiments, the third and fourth semi-circular conductive lines 203 and 204 may have the same line width, but the line width is different from the line width of the first semi-circular conductive line 201 or the second semi-circular conductive line 202. Moreover, the third and fourth semi-circular conductive lines 203 and 204 both have first and second ends 10 and 20. In this embodiment, to maintain geometric symmetry, the second end 20 of the third semi-circular conductive line 203 is electrically connected to the second end 20 of the second semi-circular conductive line 202 through a lower cross-connect 211. Two conductive plugs (not shown), respectively disposed on two ends of the lower cross-connect 211, electrically connect the second ends 20 of the second and third semi-circular conductive lines 202 and 203, respectively. Additionally, the second end 20 of the fourth semi-circular conductive line 204 is electrically connected to the second end 20 of the first semi-circular conductive line 201 through an upper cross-connect 213. In some embodiments, the second end 20 of the third semi-circular conductive line 203 can be electrically connected to the second end 20 of the second semi-circular conductive line 202 through an upper cross-connect, and the second end 20 of the fourth semi-circular conductive line 204 can be electrically connected to the second end 20 of the first semi-circular conductive line 201 through a lower cross-connect. The first ends 10 of the third and fourth semi-circular conductive lines 203 and 204 have lateral extending portions 30 and 40 for inputting differential signals (not shown). That is, the lateral extending portions 30 and 40 input the signals with the same amplitude and phase difference of 180°.

Generally, since in single-ended operation the signals with the same phase may pass through the neighboring winding layers of the inductor, the parasitic capacitance between the neighboring winding layers is lower. Accordingly, the line space between the winding layers is designed to be as small as possible to enhance the inductor performance. In current inductor design, to obtain the maximum inductance in the same occupied chip area, the neighboring winding structure of the inductor for singled-ended operation is designed according to the minimum line space allowed by the semiconductor process.

However, unlike the inductor in single-ended operation, the signals with phase difference of 180° may pass through the neighboring winding layers of the inductor in differential operation. Thus, the parasitic capacitance between the neighboring winding layers may be increased due to the signals with difference phase. In other words, if the same line space is used, the parasitic capacitance between the neighboring winding layers of the inductor in differential operation is larger than that in single-ended operation. When the parasitic capacitance is increased, peak Q-factor frequency may be reduced and the inductance value deviation increased, so that the usable frequency range of the inductor is reduced. Accordingly, in the invention, the line width W and the line space S of the semi-circular conductive line of the symmetrical inductor have a specific relationship. For example, the line space S exceeds the line width W when the line width W is less than 6 μm. Moreover, the line space S is substantially equal to the line width W when the line width W is substantially equal to 6 μm. Furthermore, the line space S is less than the line width W when the line width W exceeds 6 μm to prevent increased occupation of chip area. In particular, when the line width W does not exceed 9 μm, the relationship between line W and line space S is:

$$S=[-W/6+2]\times W$$

Additionally, when the line width W is not less than 9 μm, the relationship between the line W and the line space S is:

$$S=0.5W$$

According to the symmetrical inductor of the invention, the parasitic capacitance in the symmetrical inductor in differential operation can be reduced by the specific relationship between the line width W and the line space, thereby maintaining the usable frequency range of inductors.

Figure 3:
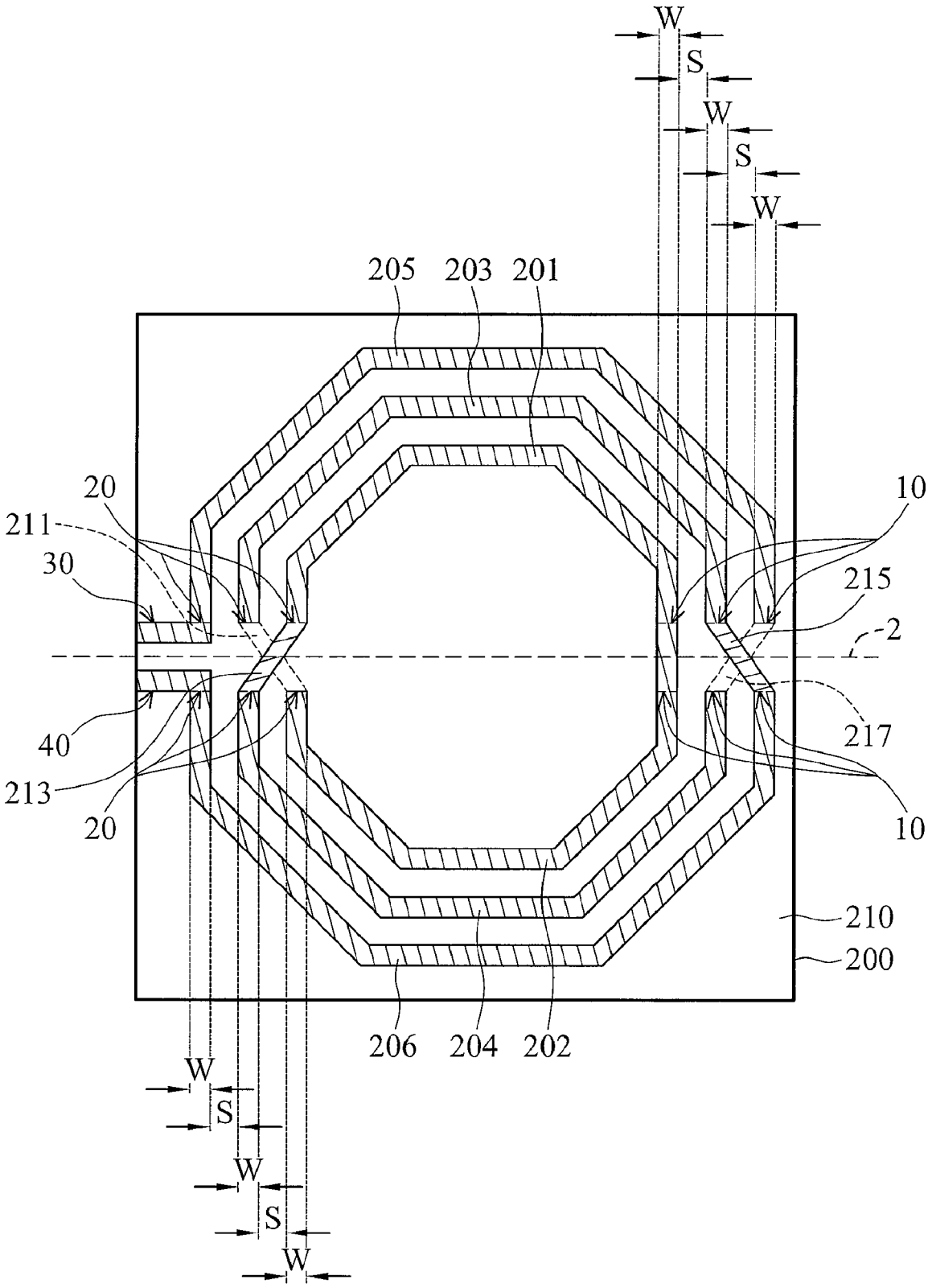
FIG. 3 is a plane view of an embodiment of a three-turn symmetrical inductor.
Figure 4:
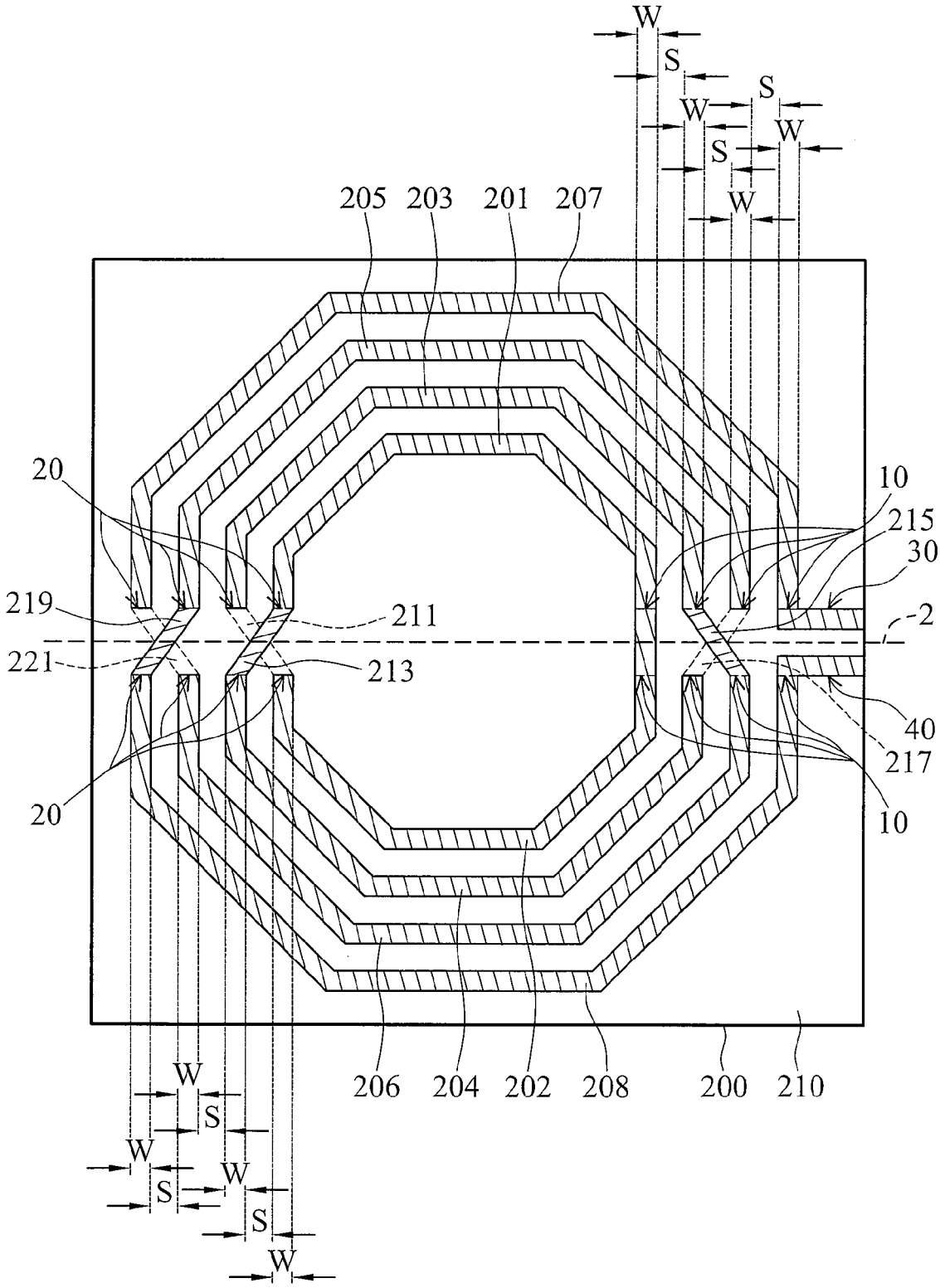
FIG. 4 is a plane view of an embodiment of a four-turn symmetrical inductor.

FIG. 3 and FIG. 4 show symmetrical inductors of other embodiments of the present invention. FIG. 3 is a plane view of a three-turn symmetrical inductor, and FIG. 4 is a plane view of a four-turn symmetrical inductor. Additionally, if the elements in FIGS. 3 and 4 are the same as those in FIG. 2, the elements will be labeled as the same reference numbers as FIG. 2 uses and will not be described again. In FIG. 3, the symmetrical inductor further comprises fifth and sixth semi-circular conductive lines 205 and 206. The fifth semi-circular conductive line 205 is disposed in the insulating layer 210, and the line 205 is also parallel to and located outside the third semi-circular conductive line 203. The sixth semi-circular conductive line 206 is disposed in the insulating layer 210. The sixth semi-circular conductive line 206 and the fifth semi-circular conductive line 205 symmetric, such that the sixth semi-circular conductive line 206 is parallel to and located outside the fourth semi-circular conductive line 204. Also, the fifth and sixth semi-circular conductive lines 205 and 206 have the same line width W and the same line space S. In some embodiments, the fifth and sixth semi-circular conductive lines 205 and 206 may have the same line width that is different from the line width W of the first semi-circular conductive line 201 or the second semi-circular conductive line 202. Moreover, each of the fifth and sixth semi-circular conductive lines 205 and 206 has first and second ends 10 and 20. The first end 10 of the fifth semi-circular conductive line 205 is electrically connected to the first end 10 of the fourth semi-circular conductive line 204 through a lower cross-connect 217. Additionally, the first end 10 of the sixth semi-circular conductive line 206 is electrically connected to the first end 10 of the third semi-circular conductive line 203 through an upper cross-connect 215. The second ends 20 of the fifth and sixth semi-circular conductive lines 205 and 206 have lateral extending portions 30 and 40 for inputting differential signals (not shown). In this embodiment, the line width W and the line space S of the semi-circular conductive lines in the symmetrical inductor have the same relationship as mentioned. Moreover, other odd-turn symmetrical inductors may have similar winding structure to the inductor shown in FIG. 3.

Referring to FIG. 4, the symmetrical inductor further comprises seventh and eighth semi-circular conductive lines 207 and 208. The seventh semi-circular conductive line 207 is parallel to and located outside the fifth semi-circular conductive line 205. The eighth semi-circular conductive line 208 and the seventh semi-circular conductive line 207 are symmetric. Also, the seventh and eighth semi-circular conductive lines 207 and 208 have the same line width W and the same line space S. Moreover, each of the seventh and eighth semi-circular conductive lines 207 and 208 has the first and second ends 10 and 20. The second end 20 of the seventh semi-circular conductive line 207 is electrically connected to the second end 20 of the sixth semi-circular conductive line 206 through a lower cross-connect 221. Additionally, the second end 20 of the eighth semi-circular conductive line 208 is electrically connected to the second end 20 of the fifth semi-circular conductive line 205 through an upper cross-connect 219. The first ends 10 of the seventh and eighth semi-circular conductive lines 207 and 208 have lateral extending portions 30 and 40 for inputting differential signals (not shown). In this embodiment, the line width W and the line space S of the semi-circular conductive lines in the symmetrical inductor have the same relationship as mentioned. Moreover, other even-turn symmetrical inductors may have the similar winding structure as the inductor shown in FIG. 3.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inductor, comprising:

an insulating layer;

a first conductive line disposed in the insulating layer, having a first end and a second end;

a second conductive line disposed in the insulating layer, having a first end and a second end, wherein the first end of the second conductive line is electrically connected to the first end of the first conductive line;

a third conductive line disposed in the insulating layer, having a first end and a second end, wherein the second end of the third conductive line is electrically connected to the second end of the second conductive line; and a fourth conductive line disposed in the insulating layer, having a first end and a second end, wherein the second end of the fourth conductive line is electrically connected to the second end of the first conductive line;

a fifth conductive line disposed in the insulating layer, having a first end and a second end, wherein the first end of the fifth conductive line is electrically connected to the first end of the fourth conductive line; and a sixth conductive line disposed in the insulating layer, having a first end a second end, wherein the first end of the sixth conductive line is electrically connected to the first end of the third conductive line;

wherein the first conductive line and the second conductive line are symmetric, and the third conductive line and the fourth conductive line are symmetric;

wherein the first conductive line is adjacent to the third conductive line, and the second conductive line is adjacent to the fourth conductive line;

wherein the line width of the first, second, third, and fourth conductive lines is not less than 9 μm, and the line space of two adjacent conductive lines is less than the line width of the first, second, third, and fourth conductive lines;

wherein the fifth conductive line and the sixth conductive line are symmetric;

wherein the third conductive line is adjacent to the fifth conductive line, and the fourth conductive line is adjacent to the sixth conductive line;

wherein the line width of the fifth and sixth conductive lines and the line space of two adjacent conductive lines have a first relationship:

if the line width exceeds 6 μm, the line space is less than the line width; or if the line width is less than 6 μm, the line space exceeds the line width; or if the line width is equal 6 μm, the line space is equal to the line width.

2. The inductor as claimed in claim 1, wherein S=0.5W, where W is the line width of the first, second, third, and fourth conductive lines and S is the line space of two adjacent conductive lines.

3. The inductor as claimed in claim 1, wherein the inductor comprises a first upper interconnect connecting the second end of the fourth conductive line and the second end of the first conductive line, and the inductor also comprises a first lower interconnect connecting the second end of the third conductive line and the second end of the second conductive line.

4. The inductor as claimed in claim 1, wherein the line width of the fifth and sixth conductive lines and the line space of two adjacent conductive lines have a second relationship:

if the line width does not exceed 9 μm, $S=[-W/6+2]\times W$, where S is the line space and W is the line width; or if the line width is not less than 9 μm, S=0.5W, where S is the line space and W is the line width.

5. The inductor as claimed in claim 1, wherein the inductor comprises a second upper interconnect connecting the first end of the sixth conductive line and the first end of the third conductive line, and the inductor also comprises a second lower interconnect connecting the first end of the fifth conductive line and the first end of the fourth conductive line.

6. The inductor as claimed in claim 1, wherein the conductive line is circular, rectangular, hexagonal, octagonal, or polygonal.

7. An inductor, comprising:

an insulating layer;

a first conductive line disposed in the insulating layer, having a first end and a second end;

a second conductive line disposed in the insulating layer, having a first end and a second end, wherein the first end of the second conductive line is electrically connected to the first end of the first conductive line;

a third conductive line disposed in the insulating layer, having a first end and a second end, wherein the second end of the third conductive line is electrically connected to the second end of the second conductive line; and a fourth conductive line disposed in the insulating layer, having a first end and a second end, wherein the second end of the fourth conductive line is electrically connected to the second end of the first conductive line;

wherein the first conductive line and the second conductive line are symmetric, and the third conductive line and the fourth conductive line are symmetric;

wherein the first conductive line is adjacent to the third conductive line, and the second conductive line is adjacent to the fourth conductive line;

wherein the line width of the first, second, third, and fourth conductive lines does not exceed 9 μm and is not less than 6 μm, and if the line width exceeds 6 μm the line space of two adjacent conductive lines is less than the line width or if the line width is equal 6 μm the line space is equal to the line width.

8. The inductor as claimed in claim 7, wherein $S=[-W/6+2]\times W$, where W is the line width of the first, second, third, and fourth conductive lines and S is the line space of two adjacent conductive lines.

9. The inductor as claimed in claim 7, wherein the conductive line is circular, rectangular, hexagonal, octagonal, or polygonal.

10. The inductor as claimed in claim 7, wherein the inductor comprises a first upper interconnect connecting the second end of the fourth conductive line and the second end of the first conductive line, and the inductor also comprises a first lower interconnect connecting the second end of the third conductive line and the second end of the second conductive line.

11. The inductor as claimed in claim 7, further comprising:

a fifth conductive line disposed in the insulating layer, having a first end and a second end, wherein the first end of the fifth conductive line is electrically connected to the first end of the fourth conductive line; and a sixth conductive line disposed in the insulating layer, having a first end a second end, wherein the first end of the sixth conductive line is electrically connected to the first end of the third conductive line;

wherein the fifth conductive line and the sixth conductive line are symmetric;

wherein the third conductive line is adjacent to the fifth conductive line, and the fourth conductive line is adjacent to the sixth conductive line;

wherein the line width of the fifth and sixth conductive lines and the line space of two adjacent conductive lines have a first relationship:

if the line width exceeds 6 μm, the line space is less than the line width; or if the line width is less than 6 μm, the line space exceeds the line width; or if the line width is equal 6 μm, the line space is equal to the line width.

12. The inductor as claimed in claim 11, wherein the line width of the fifth and sixth conductive lines and the line space of two adjacent conductive lines have a second relationship:

if the line width does not exceed 9 μm, $S=[-W/6+2]\times W$, where S is the line space and W is the line width; or if the line width is not less than 9 μm, $S=0.5W$, where S is the line space and W is the line width.

13. The inductor as claimed in claim 11, wherein the inductor comprises a second upper interconnect connecting the first end of the sixth conductive line and the first end of the third conductive line, and the inductor also comprises a second lower interconnect connecting the first end of the fifth conductive line and the first end of the fourth conductive line.

14. An inductor, comprising:

an insulating layer;

a first conductive line disposed in the insulating layer, having a first end and a second end;

a second conductive line disposed in the insulating layer, having a first end and a second end, wherein the first end of the second conductive line is electrically connected to the first end of the first conductive line;

a third conductive line disposed in the insulating layer, having a first end and a second end, wherein the second end of the third conductive line is electrically connected to the second end of the second conductive line; and a fourth conductive line disposed in the insulating layer, having a first end and a second end, wherein the second end of the fourth conductive line is electrically connected to the second end of the first conductive line;

wherein the first conductive line and the second conductive line are symmetric, and the third conductive line and the fourth conductive line are symmetric;

wherein the first conductive line is adjacent to the third conductive line, and the second conductive line is adjacent to the fourth conductive line;

wherein the line width of the first, second, third, and fourth conductive lines is not less than 6 μm, and $S=[-W/6+2]\times W$, where W is the line width of the first, second, third, and fourth conductive lines and S is the line space of two adjacent conductive lines.

15. The inductor as claimed in claim 14, wherein the conductive line is circular, rectangular, hexagonal, octagonal, or polygonal.

16. The inductor as claimed in claim 14, wherein the inductor comprises a first upper interconnect connecting the second end of the fourth conductive line and the second end of the first conductive line, and the inductor also comprises a first lower interconnect connecting the second end of the third conductive line and the second end of the second conductive line.

17. The inductor as claimed in claim 14, further comprising:

a fifth conductive line disposed in the insulating layer, having a first end and a second end, wherein the first end of the fifth conductive line is electrically connected to the first end of the fourth conductive line; and a sixth conductive line disposed in the insulating layer, having a first end a second end, wherein the first end of the sixth conductive line is electrically connected to the first end of the third conductive line;

wherein the fifth conductive line and the sixth conductive line are symmetric;

wherein the third conductive line is adjacent to the fifth conductive line, and the fourth conductive line is adjacent to the sixth conductive line;

wherein the line width of the fifth and sixth conductive lines and the line space of two adjacent conductive lines have a first relationship:

if the line width exceeds 6 μm, the line space is less than the line width; or if the line width is less than 6 μm, the line space exceeds the line width; or if the line width is equal 6 μm, the line space is equal to the line width.

18. The inductor as claimed in claim 17, wherein the line width of the fifth and sixth conductive lines and the line space of two adjacent conductive lines have a second relationship:

if the line width does not exceed 9 μm, $S=[-W/6+2]\times W$, where S is the line space and W is the line width; or if the line width is not less than 9 μm, $S=0.5W$, where S is the line space and W is the line width.

19. The inductor as claimed in claim 17, wherein the inductor comprises a second upper interconnect connecting the first end of the sixth conductive line and the first end of the third conductive line, and the inductor also comprises a second lower interconnect connecting the first end of the fifth conductive line and the first end of the fourth conductive line.

* * * * *